US010053895B2

(12) United States Patent
Cervantes, Jr.

(10) Patent No.: US 10,053,895 B2
(45) Date of Patent: Aug. 21, 2018

(54) DOOR HOLDING DEVICE

(71) Applicant: Ramon Cervantes, Jr., Dallas, TX (US)

(72) Inventor: Ramon Cervantes, Jr., Dallas, TX (US)

(73) Assignee: Ramon Cervantes, Jr., Dallas, TX (US)

( * ) Notice: Subject to any disclaimer, the term of this patent is extended or adjusted under 35 U.S.C. 154(b) by 276 days.

(21) Appl. No.: 15/063,542

(22) Filed: Mar. 8, 2016

(65) Prior Publication Data

US 2017/0002592 A1 Jan. 5, 2017

Related U.S. Application Data

(60) Provisional application No. 62/177,268, filed on Mar. 10, 2015.

(51) Int. Cl.
*E05C 17/56* (2006.01)
*E05C 17/20* (2006.01)
*E05C 17/00* (2006.01)

(52) U.S. Cl.
CPC ..... *E05C 17/56* (2013.01); *E05C 17/003* (2013.01); *E05C 17/203* (2013.01)

(58) Field of Classification Search
CPC ..... E05Y 2201/218; E05Y 2201/224; Y10T 16/61; Y10T 292/28; Y10T 16/27; Y10T 16/54; E05D 11/1085; E05D 11/1057; E05D 11/1064; E05D 2011/1092; E05F 3/108
USPC ..... 292/338, DIG. 15
See application file for complete search history.

(56) References Cited

U.S. PATENT DOCUMENTS 5,444,894 A * 8/1995 Heiler ..... E05D 7/121 16/257
5,862,570 A * 1/1999 Lezuch ..... E05C 17/085 16/82
6,237,190 B1 * 5/2001 Grumm ..... E05C 17/32 16/82
6,370,732 B1 * 4/2002 Yezersky ..... E05C 17/203 16/82
7,640,627 B2 * 1/2010 Lowen ..... E05C 17/203 16/334
9,650,824 B2 * 5/2017 Sauerwein ..... E05F 5/00
9,850,695 B2 * 12/2017 Torres Fernandez ..... H05K 999/00
2003/0163895 A1 * 9/2003 Liang ..... E05C 17/203 16/82
2009/0051192 A1 * 2/2009 Ewing ..... E05F 15/622 296/146.2
2011/0266080 A1 * 11/2011 Schmitt ..... E05C 17/006 180/89.1
2013/0074412 A1 * 3/2013 Wellborn ..... E05C 17/203 49/381
2014/0096342 A1 * 4/2014 Kim ..... E05C 17/203 16/82
2015/0354259 A1 * 12/2015 Broadhead ..... E05F 5/06 16/82

* cited by examiner

*Primary Examiner* — Mark A Williams

(57) ABSTRACT

A door holding device for selectively holding and releasing a vehicle door may include a door holding arm being connected to a vehicle and slidably connected to a door of the vehicle; a plunger shaft for selectively engaging the door holding arm; a guide pin; and a channel; a guide block to guide the plunger shaft; a bearing to stabilize the travel of the door holding arm.

6 Claims, 4 Drawing Sheets

DOOR HOLDING DEVICE

FIELD OF THE INVENTION

The present invention relates to a door holding device and more particularly to a device to freeze the motion of a vehicle door by switches and electrical solenoids.

BACKGROUND

Vehicle doors especially automobile doors can be heavy and cumbersome for the user of the doors especially the young and old. The automobile doors can be extremely heavy and present a burden to open and close. When opening the doors, gravity or other conditions such as high winds may cause these doors begin to close before the user of the door has had the opportunity to exit the vehicle. This may be a dangerous situation if the user has already placed a leg or an arm outside of the door. The slamming door can be painful and can cause injuries to the user, and the user may not have enough strength to prevent the door form slamming. Under these circumstances, it is desirable to have a mechanism to freeze the motion of the door without using the strength of the user. Furthermore, millions of dollars may be saved from preventing these types of injuries to persons and preventing damages to other vehicles.

SUMMARY

A door holding device for selectively holding and releasing a vehicle door may include a door holding arm being connected to a vehicle and slidably connected to a door of the vehicle; a plunger shaft for selectively engaging the door holding arm by means of interacting surfaces located on the door holding arm and an end of the plunger shaft respectively; a guide block to guide the plunger shaft; a bearing to stabilize the travel of the door holding arm.

The door holding arm may include teeth to engage the plunger shaft.

The bearing may be biased by a bias device.

The bias device may be a spring.

The door holding arm may include a channel.

The bearing may include a ball bearing.

The plunger shaft may be controlled by an actuating means including a switch.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
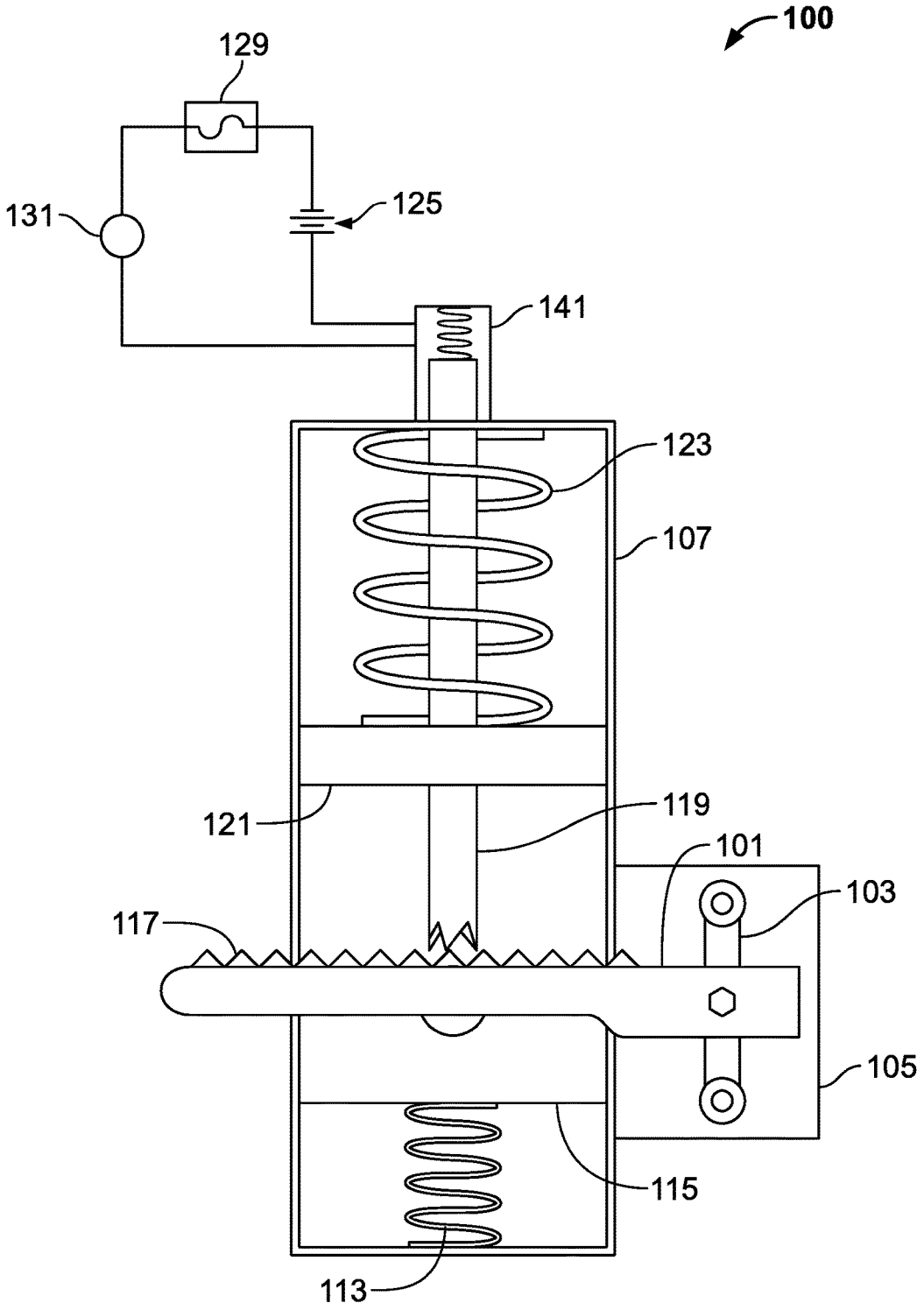
FIG. 1 illustrates a cross-sectional view of the front of the door holding device of the present invention.

FIG. 1 illustrates a cross-sectional view of the front of the door holding device 100 of the present invention and illustrates a door holding arm 101 which may be connected to support device 103 which may be a bracket attached to the vehicle 105 to support the door holding arm 101. The door holding arm 101 may extend into a door of the vehicle 105. FIG. 1 additionally illustrates a housing 107 to house the door holding device 100 of the present invention. As the door of the vehicle 105 opens, the housing 107 and the door holding device 100 moves along the door holding arm 101, and as the door of the vehicle 105 closes, the housing 107 and the device 100 moves along the door holding arm 101 in the opposite direction than when the door is opening. The door holding arm 101 may include a channel 109 to mate with a bearing 111 which may be a ball bearing to stabilize the door holding arm 101 as the housing 107 moves with respect to the door holding arm 101. The door holding arm 101 interacting with an end of the plunger shaft by means of interacting surfaces, which may include teeth 117 which may be opposed to the channel 109. The teeth 107 may mate with interacting surfaces on an end of a plunger shaft 119 which may extend longitudinally in the housing 107. The plunger shaft 119 may extend through an aperture of a guide block 121 which may act as a collar for the plunger shaft 119 to stabilize the plunger shaft 119.

The plunger shaft 119 may engage the teeth 117 in order to stop the movement of the door holding arm 101 which may prevent the door from moving either open or closed and preventing an injury to the user of the door. The plunger shaft 119 may be withdrawn from the teeth 117 (see FIG. 3) in order to allow the door holding arm 101 to move relatively freely with respect to the housing 107, allowing the door of the vehicle 105 to move freely allowing the user to enter and exit the vehicle 105. A plunger actuation means is provided, including a plunger coil 123 that may be energized in order to moves the plunger shaft 119 to engage or disengage with the teeth 117. The plunger coil 123 may be connected to a battery 125 which may be the car battery such as 12 V battery which may be connected to a fuse box 127 and connected to switch 131 in order to control the plunger coil 123 when the switch is activated, and thereby control the plunger shaft 119.

The bearing 111 may cooperate with a biasing device 113 which may include a spring to bias the bearing 111 in order to stabilize the door holding arm 101. The spring may be connected to a movable wall 115 which extends and retracts within the housing 107.

Figure 2:
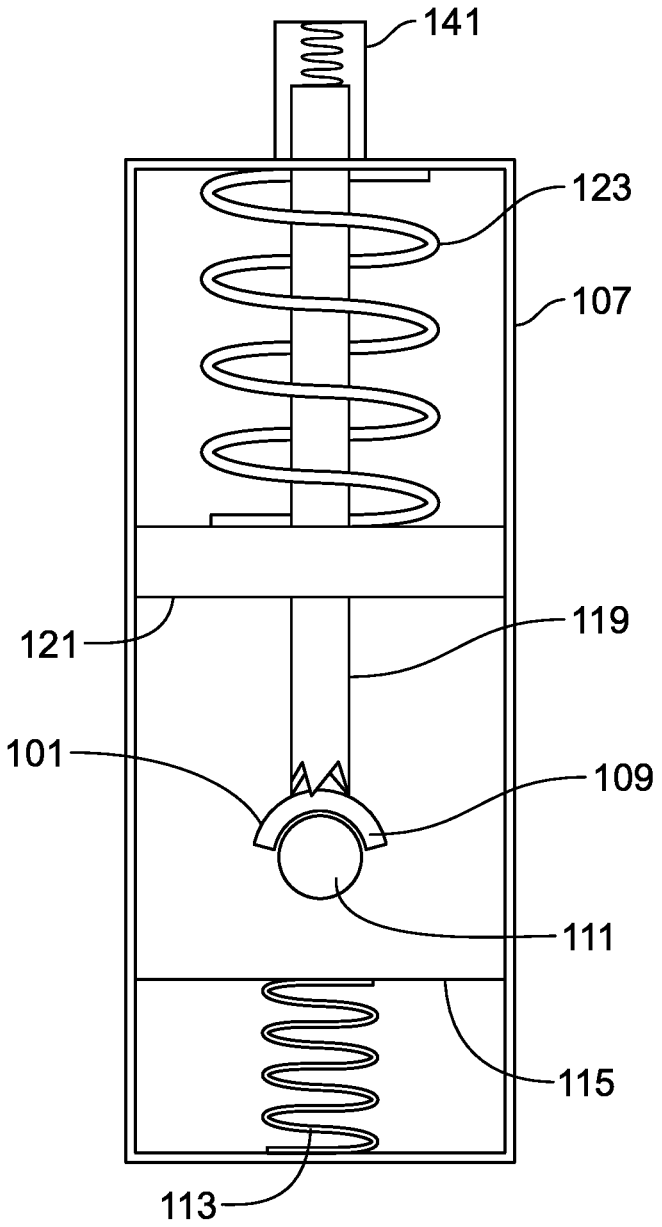
FIG. 2 illustrates a cross-sectional side view of the door holding device of the present invention.

FIG. 2 illustrates a cross-sectional view of the side of the door holding device 100 of the present invention and illustrates a door holding arm 101 which may be connected to support device 103 which may be a bracket attached to the vehicle 105 to support the door holding arm 101. The door holding arm 101 may extend into a door of the vehicle 105. FIG. 1 additionally illustrates a housing 107 to house the door holding device 100 of the present invention. As the door of the vehicle 105 opens, the housing 107 and the door holding device 100 moves along the door holding arm 101, and as the door of the vehicle 105 closes, the housing 107 and the device 100 moves along the door holding arm 101 in the opposite direction than when the door is opening. The door holding arm 101 may include a channel 109 to mate with a bearing 111 which may be a ball bearing to stabilize the door holding arm 101 as the housing 107 moves with respect to the door holding arm 101. The door holding arm 101 may include teeth 117 which may be opposed to the channel 109. The teeth 107 may mate with an end of a plunger shaft 119 which may extend longitudinally in the housing 107. The plunger shaft 119 may extend through an aperture of a guide block 121 which may act as a collar for the plunger shaft 119 to stabilize the plunger shaft 119.

The plunger shaft 119 may engage the teeth 117 in order to stop the movement of the door holding arm 101 which may prevent the door from moving either open or closed and preventing an injury to the user of the door. The plunger shaft 119 may be withdrawn from the teeth 117 (see FIG. 3) in order to allow the door holding arm 101 to move relatively freely with respect to the housing 107, allowing the door of the vehicle 105 to move freely allowing the user to enter and exit the vehicle 105. A plunger coil 123 may be energized in order to moves the plunger shaft 119 to engage or disengage with the teeth 117. The plunger coil 123 may be connected to a battery 125 which may be the car battery such as 12 V battery which may be connected to a fuse box 127 and connected to switch 131 in order to control the plunger coil 123 and control the plunger shaft 119.

The bearing 111 may cooperate with a biasing device 113 which may include a spring to bias the bearing 111 in order to stabilize the door holding arm 101. The spring may be connected to a movable wall 115 which extends and retracts within the housing 107.

FIGS. 1 and 2 show the door holding arm 101 being locked by the plunger shaft 119 in a first position, and FIGS. 1 and 2 show the actuator 141 to raise and lower the plunger shaft 119 by energizing the plunger coil 123.

Figure 3:
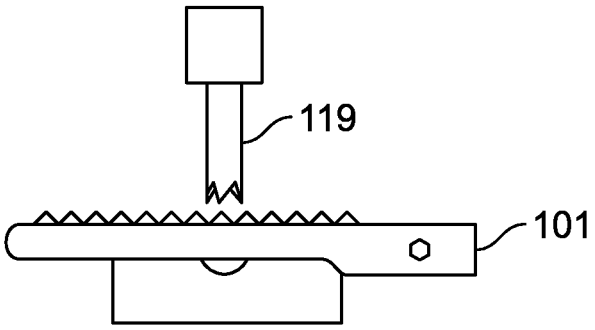
FIG. 3 illustrates a cross-sectional view of a portion of the door holding device of the present invention.

FIG. 3 shows the door holding arm 101 being unlocked and able to travel unrestrained by the plunger 119 in a second position.

Figure 4:
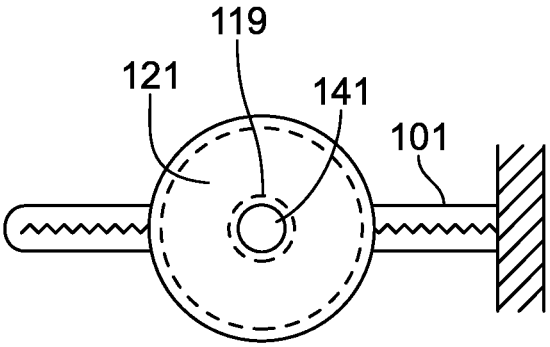
FIG. 4 illustrates a top cross-sectional view of the door holding device of the present invention.

FIG. 4 illustrates a top view of the door holding device 100 and illustrates the actuator 141, the door holding arm 101 and the guide block (collar) 121.

Figure 5:
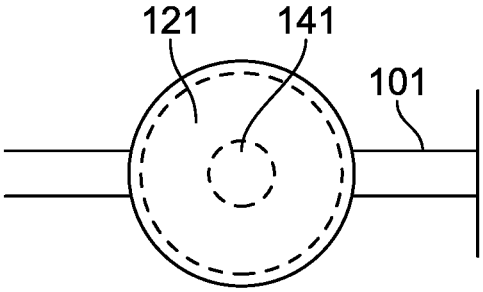
FIG. 5 illustrates a bottom cross-sectional view of the door holding device of the present invention.

FIG. 5 illustrates a bottom view of the door holding device 100 of the present invention and illustrates the door holding arm 101, the solenoid 141 and the guide block (collar) 121.

Figure 6:
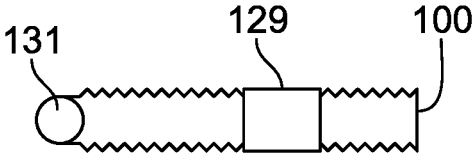
FIG. 6 illustrates an electrical switch and fuse box.

FIG. 6 illustrates the switch 131 which may be connected to the fuse 129 which may be connected to the solenoid 141.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A door holding device for holding and releasing a vehicle door, the door holding device comprising:

a housing configured to be fixably mounted to a vehicle door;

a door holding arm, the door holding arm being configured to be fixably connected to a vehicle and the door holding arm being configured, to be slidably connected to the door of the vehicle by at least a portion of the door holding arm extending through at least one opening in the housing;

a plunger shaft mounted within the housing, the plunger shaft configured for selectively engaging the door holding arm by means of interacting surfaces located on the holding arm and the plunger shaft respectively;

a guide block to guide the plunger shaft;

a bearing to stabilize travel of the door holding arm as the housing moves with respect to the door holding arm;

actuation means for controlling movement of the plunger shaft; the actuation means including a switch;

wherein, based on an activation of the switch, the actuation means is adapted to move the plunger shaft such that the interacting surfaces engage, so that the vehicle door is prevented from moving relative to the vehicle.

2. A door holding device for holding and releasing a vehicle door as in claim 1, wherein the interacting surfaces of the door holding arm include teeth on the door holding arm to engage the plunger shaft.

3. A door holding device for holding and releasing a vehicle door as in claim 1, wherein the bearing is biased by a bias device.

4. A door holding device for holding and releasing a vehicle door as in claim 3, wherein the bias device is a spring.

5. A door holding device for holding and releasing a vehicle door as in claim 1, wherein the door holding arm includes a channel.

6. A door holding device for holding and releasing a vehicle door as in claim 1, wherein the bearing includes a ball bearing.

* * * * *